United States Patent [19]

Tüshaus et al.

[11] Patent Number: 4,876,868

[45] Date of Patent: Oct. 31, 1989

[54] METHOD FOR FORMING AN OBJECT OF METAL BY COLD PRESSING

[75] Inventors: Hans-Joachim Tüshaus, Hanau; Michael Hörmann, Möbris, both of Fed. Rep. of Germany

[73] Assignee: W. C. Heraeus GmbH, Hanau, Fed. Rep. of Germany

[21] Appl. No.: 301,808

[22] Filed: Jan. 25, 1989

[30] Foreign Application Priority Data

Feb. 13, 1988 [DE] Fed. Rep. of Germany ..... 3804567

[51] Int. Cl.[4] ..... B21C 23/32; B21C 23/20; B21J 3/00

[52] U.S. Cl. ..... 72/42; 72/267; 72/700

[58] Field of Search ..... 72/41, 42, 46, 267, 72/273, 700

[56] References Cited

U.S. PATENT DOCUMENTS

| | | | |
|---|---|---|---|
| 3,255,621 | 6/1966 | Ohsol | 72/42 |
| 3,335,073 | 8/1967 | Dunn | 72/700 X |
| 3,777,528 | 12/1973 | Sirantoine | 72/41 |
| 4,129,022 | 12/1978 | Thönnes et al. | 72/41 |

FOREIGN PATENT DOCUMENTS

| | | | |
|---|---|---|---|
| 231928 | 1/1986 | German Democratic Rep. | 72/42 |
| 51-56760 | 5/1976 | Japan | 72/42 |

*Primary Examiner*—E. Michael Combs
*Attorney, Agent, or Firm*—Felfe & Lynch

[57] ABSTRACT

A method for forming in a single step metal slugs of tantalum, niobium or a base alloy of one of these metals, by cold pressing. A lubricant film is either an oxide coating on the metal, into which a polytetrafluorethylene of low molecular weight is embedded, or it is a film of chlorotrifluorethylene. A metal slug is shaped by means of a hard-metal punch with a crowned bottom surface on its punch head and a rounded undercut in the area of the transition from the punch head to the punch shank.

7 Claims, 1 Drawing Sheet

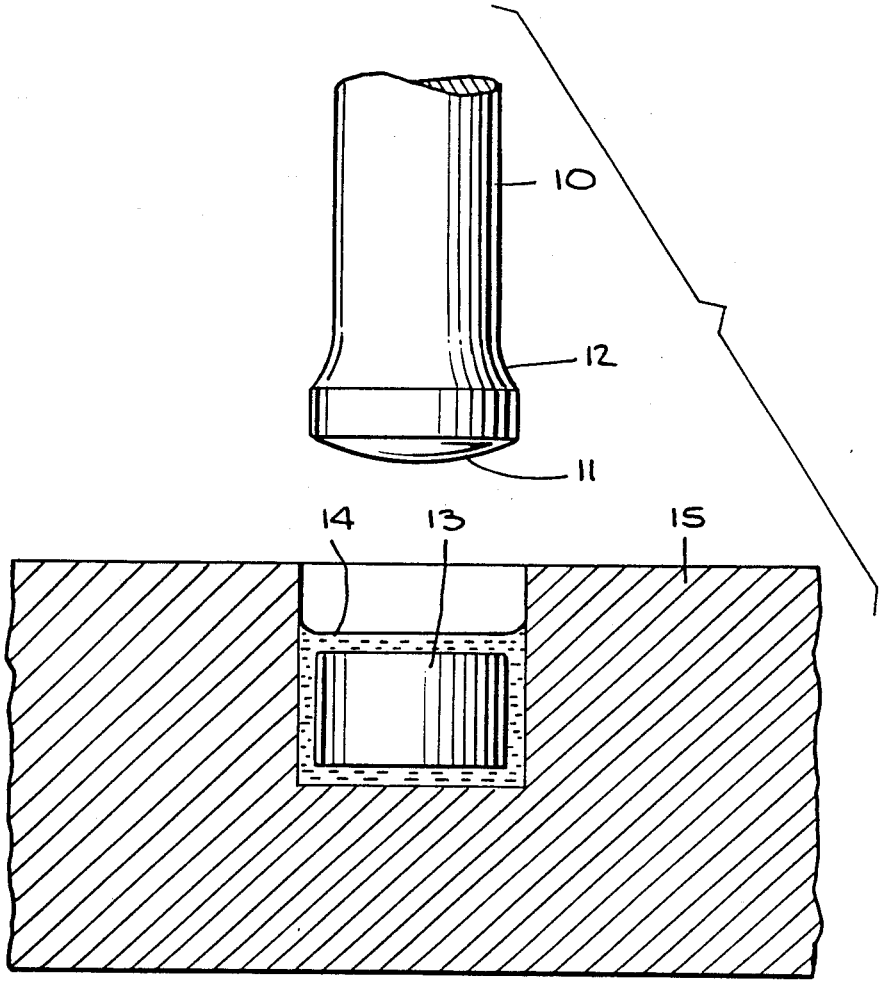
10
12
11
14
13
15

METHOD FOR FORMING AN OBJECT OF METAL BY COLD PRESSING

The invention relates to a method for forming an object from a metal of the group, tantalum, niobium and a base alloy of one of these metals, by cold pressing using as lubricant a plastic containing fluorine.

The cold forming method of "cold pressing" of tantalum is disclosed in the periodical, "Umformtechnik 15 (1981) 3, pp. 31 ff." and its advantages are to be seen in the low loss of material. The forming was performed in four individual steps on an upright crank press. Tantalum has a strong tendency to weld to steel at the high pressure used in cold pressing operations. When ordinary cold-working chromium steels were used, satisfactory results were not obtained with any of the lubricants tested, including PTFE coatings. Sufficient results could be achieved only by a combination of several measures, including the use of different materials for the active parts, the additional surface treatment thereof, and lubrication with a lubricant mixture. Which of these measures were actually used was not further specified. In any case, an optimum solution was not achieved thereby.

German Federal Patent 14 94 402 has disclosed an agent for producing protective coatings with a low coefficient of friction. It consists of a dispersion of a fluorinated carbon polymer of low molecular weight and a thermosetting or thermoplastic resin which can also contain a lesser amount of a polytetrafluorethylene of high molecular weight.

An object of the invention is to optimize the production of a body from a metal of the group of tantalum, niobium and a base alloy of one of these metals, by cold pressing.

SUMMARY OF THE INVENTION

This object is accomplished in accordance with the invention, for the method specified above, by applying to a metal slug a lubricant film which consists of chlorotrifluorethylene, or of an oxide of the metal in which polytetrafluorethylene of low molecular weight is embedded, and then the metal slug is cold-formed to the body in a single step by means of a hard-metal punch, by back-flow pressing wherein the punch has a head provided with a crowned bottom surface and a rounded undercut in the area of the transition from the head to the shank of the punch.

It has been found advantageous to oxidize the metal slug anodically, then spray it with a solution of polytetrafluorethylene and evaporate the solvent. Preferably the polytetrafluorethylene solution is sprayed onto a heated, anodically oxidized metal slug which has been heated to temperature of preferably 150° C. It has proven desirable to use as the polytetrafluorethylene solution a dispersion of a finely divided polytetrafluorethylene of low molecular weight dissolved in a resin solvent, plus a thermoplastic resin, and to spray it onto the anodically oxidized, heated or unheated, metal slug. A punch that has proven very useful for the forming operation is one whose head crowning ranges from 20 to 30 microns. A good material for the punch is especially one which consists of a cobalt matrix in which tungsten carbide is embedded.

By the use in accordance with the invention of a tribological system which virtually assures a "floating" support of the slug and hard metal punch, as well as the use of a punch with a crowned bottom surface on its head and a rounded undercut in the are of the transition from the punch head to the punch shank, it is possible to shape slugs of tantalum, niobium or a base alloy of one of these metals in automatic transfer press lines, in a continuous and trouble-free manner, without the need for any considerable after-working of the shaped products. It is furthermore a great advantage that the cold pressing is now performed in a single step.

In accordance with the invention, a method for making a body from a metal from the group consisting of tantalum, niobium and a base alloy of one of these metals comprises applying to a metal slug a lubricant film which consists of an oxide coating of the metal in which at least one of polytetrafluorethylene of low molecular weight and chlorotrifluorethylene is embedded. The method comprises then cold forming the metal slug by using a hard-metal punch in a single step to the body by backflow pressing. The punch has a head provided with a crowned bottom surface and a rounded undercut in the area of the transition from the punch head to the punch shank.

For a better understanding of the present invention, together with other and further objects thereof, reference is made to the following description, taken in connection with the accompanying drawing, and its scope will be pointed out in the appended claims.

Referring to the single Figure of the drawing, there is represented in sectional view a die containing a slug surrounded by lubricant and a punch in side elevational view.

BRIEF DESCRIPTION OF THE PREFERRED EMBODIMENT

The method of the invention will be further explained through the following example.

First slugs 7 mm in diameter and 6.5 mm thick are sheared from a cylindrical bar of tantalum. For degreasing, a great number of slugs, for example 2000 pieces, are placed in a commercial ultrasonic cleaning apparatus containing as the cleaning agent a fluorochloro hydrocarbon, e.g., 1,1,2-trichloro-1,2,2-trifluoroethane. The degreasing operation is followed by tumble-grinding for a period of about 12 hours in a drum. The grinding is performed with the addition of water and ceramic bodies.

Then the ground metal slugs are pressed flat in a closed die of hard metal, changing the dimensions of the slugs to about 9.6 mm in diameter and 3.6 mm in thickness. This flattening operation is again followed by degreasing in the ultrasonic bath, as described above, and another tumble-grinding amounting to only about 8 hours. The tantalum slugs thus prepared are now subjected to a recrystallization annealing in a high vacuum of about $10^{-5}$ mbar at a temperature of about 1350° C. for a period of about 1 hour. After the tantalum slugs have cooled to room temperature they are wetted with chlorotrifluorethylene and placed in a die of hard metal in which they are cold-pressed by means of the press punch in a single step to a cup shape. The crowning of the head of the press punch amounted to 28 microns; cobalt was used as the material of the punch, with tungsten carbide particles embedded in its matrix.

The cups made in accordance with the invention had a bottom thickness of about 0.4 mm, a length of about 18 mm, an inside diameter of about 8.7 mm, and an outside diameter of about 9.5 mm. The cups required no afterworking.

As a variant of this example, an oxide coating of the metal in which polytetrafluorethylene of low molecular weight is embedded can also be used as a tribological system as described. The preparation of this tribological system follows the recrystallization step in accordance with the previous example. For this purpose the tantalum slug is immersed as the anode into polytetrafluorethylene, and the solvent is evaporated about 150° C. This is then followed by the cold pressing, as described above.

Referring now more particularly to the drawing, a suitable punch 10 has a rounded undercut 12 in the area of the transition from the punch head 11 to the punch shank 10. The punch head 11 is provided with a crowned or convex bottom surface. The metal slug 13 is positioned with a lubricant film 14 in a suitable die 15.

While there has been described what is at present considered to be the preferred embodiment of this invention, it will be obvious to those skilled in the art that varius changes and modifications may be made therein without departing from the invention, and it is, therefore, aimed to cover all such changes and modifications as fall within the true spirit and scope of the invention.

What is claimed is:

1. Method for making a body from a metal from the group consisting of tantalum, niobium and a base alloy of one of these metals comprising:

applying to a metal slug a lubricant film which consists of an oxide coating of said metal, embedding at least one of polytetrafluorethylene of low molecular weight and chlorotrifluorethylene in said metal oxide coating, and then cold forming the metal slug by forcing a hard-metal punch in a single step into said slug to shape said body by backflow pressing, the punch having a shank and a head provided with a crowned bottom surface and a rounded undercut in an area of transition between said punch head and said punch shank.

2. Method in accordance with claim 1, which comprises before said cold forming, anodically oxidizing the metal slug and then spraying the metal slug with a solution containing polytetrafluorethylene and evaporating the solvent.

3. Method in accordance with claim 2, which comprises heating the anodically oxidized metal slug and in which the spraying comprises spraying the solution containing polytetrafluorethylene onto the heated, anodically oxidized metal slug.

4. Method in accordance with claim 3, in which the heating comprises heating the anodically oxidized metal slug to about 150° C.

5. Method in accordance with claim 2, in which the spraying comprises spraying a dispersion, dissolved in a resin solvent, of a finely divided polytetrafluorethylene of low molecular weight, and of a thermoplastic resin, onto the anodically oxidized metal slug.

6. Method in accordance with claim 1, in which the cold forming step is performed using a punch whose bottom surface crown is in the range of 20 to 30 microns.

7. Method in accordance with claim 1, in which the cold forming step is performed using a punch of cobalt comprising particles of tungsten carbide embedded in a cobalt matrix.

* * * * *